US007260872B2

(12) United States Patent
Schultz

(10) Patent No.: US 7,260,872 B2
(45) Date of Patent: Aug. 28, 2007

(54) CASKET ORNAMENT ATTACHMENT SYSTEM AND METHOD

(75) Inventor: Craig H. Schultz, York, PA (US)

(73) Assignee: Matthews Resources, Inc., Wilmington, DE (US)

( * ) Notice: Subject to any disclaimer, the term of this patent is extended or adjusted under 35 U.S.C. 154(b) by 259 days.

(21) Appl. No.: 10/933,678

(22) Filed: Sep. 2, 2004

(65) Prior Publication Data

US 2005/0076485 A1 Apr. 14, 2005

Related U.S. Application Data

(60) Provisional application No. 60/500,851, filed on Sep. 4, 2003.

(51) Int. Cl.
*A61G 17/00* (2006.01)

(52) U.S. Cl. ..... 27/10; 52/287.1; 403/353

(58) Field of Classification Search ..... 27/10, 27/19, 2; D99/8, 13; 52/287.1, 288.1; 403/353, 403/375, 381

See application file for complete search history.

(56) References Cited

U.S. PATENT DOCUMENTS

| | | | | |
|---|---|---|---|---|
| 2,106,695 | A | 1/1938 | Larson | |
| 2,141,734 | A | 12/1938 | Besch | |
| 2,213,506 | A | 9/1940 | Thoresen | |
| 2,264,243 | A | 11/1941 | Knuth | |
| 2,425,015 | A * | 8/1947 | Van Sant | 140/71.5 |
| 2,450,091 | A | 9/1948 | Kendall | |
| 2,569,210 | A * | 9/1951 | Welk | 408/51 |
| 3,025,624 | A | 3/1962 | Harrell | |
| 3,491,820 | A | 1/1970 | Ostling | |
| 3,828,499 | A | 8/1974 | Leddy | |
| 3,962,761 | A | 6/1976 | Boughner | |
| 3,966,315 | A * | 6/1976 | Styles et al. | 353/101 |
| 4,185,422 | A | 1/1980 | Radek | |
| 4,195,394 | A | 4/1980 | Semon | |
| 4,267,623 | A | 5/1981 | Christian | |
| 4,357,741 | A | 11/1982 | Winburn et al. | |
| 4,363,581 | A | 12/1982 | Pease | |
| 4,473,316 | A | 9/1984 | Welch | |
| 4,571,790 | A | 2/1986 | James, III | |
| 5,144,727 | A | 9/1992 | Craft | |
| 5,335,402 | A | 8/1994 | Semon | |
| 5,377,395 | A | 1/1995 | Maier et al. | |
| 5,531,000 | A | 7/1996 | Biondo | |
| 5,604,965 | A | 2/1997 | Shaw et al. | |
| 5,624,045 | A | 4/1997 | Highsmith et al. | |
| D390,321 | S | 2/1998 | Maple et al. | |
| 5,716,154 | A | 2/1998 | Miller et al. | |
| 5,806,258 | A | 9/1998 | Miedema et al. | |

(Continued)

FOREIGN PATENT DOCUMENTS

| | | |
|---|---|---|
| CA | 2242113 | 2/2000 |

(Continued)

*Primary Examiner*—William L. Miller
(74) *Attorney, Agent, or Firm*—Reed Smith LLP

(57) ABSTRACT

A decorative ornament is attached to a casket having an ornament attachment plate. The ornament may be attached to corner member or other portion of the casket. Each ornament attachment plate has a pair of grooves including a straight groove and a curved groove for receiving fasteners on the back of the ornament.

24 Claims, 3 Drawing Sheets

U.S. PATENT DOCUMENTS

| | | | | |
|---|---|---|---|---|
| D411,461 | S | 6/1999 | Schultz | |
| 5,918,845 | A | 7/1999 | Whitaker | |
| 5,938,048 | A | 8/1999 | Carroll et al. | |
| 5,943,820 | A | 8/1999 | O'Connell | |
| 5,960,524 | A | 10/1999 | Darby et al. | |
| D418,961 | S | 1/2000 | Biondo et al. | |
| 6,088,973 | A | 7/2000 | Weiss | |
| 6,092,694 | A | 7/2000 | Sadow | |
| 6,109,819 | A | 8/2000 | Welch | |
| 6,138,335 | A | 10/2000 | Drawbaugh et al. | |
| D433,585 | S | 11/2000 | Bowers et al. | |
| 6,196,758 | B1 | 3/2001 | Scarborough | |
| 6,237,202 | B1 | 5/2001 | Agee et al. | |
| 6,317,945 | B1 | 11/2001 | Laphan et al. | |
| 6,543,103 | B1 | 4/2003 | Robert | |
| 6,557,222 | B2 | 5/2003 | Groemminger et al. | |
| 6,591,466 | B1 | 7/2003 | Acton et al. | |
| 6,928,706 | B2 * | 8/2005 | Acton et al. | 27/10 |
| 2003/0192155 | A1 | 10/2003 | Acton et al. | |
| 2003/0192156 | A1 | 10/2003 | Groemminger et al. | |

FOREIGN PATENT DOCUMENTS

| | | |
|---|---|---|
| CA | 2279703 | 2/2000 |

* cited by examiner

CASKET ORNAMENT ATTACHMENT SYSTEM AND METHOD

This application claims the benefit under 35 USC 119(e) of U.S. Provisional Application Ser. No. 60/500,851 filed Sep. 4, 2003.

FIELD OF THE INVENTION

The present invention relates to caskets, and, more specifically to a system and method for attaching interchangeable decorative ornaments to a casket.

BACKGROUND OF THE INVENTION

Caskets can be customized by selecting personalized trim or decorations to be installed on the casket. The decorations may capture the character and interest of the person being remembered. One such personalization typically includes decorative ornaments installed on the corners of the casket.

SUMMARY OF THE INVENTION

In accordance with the principles of an embodiment of the present invention there is disclosed a casket ornament attachment system and method. A casket may be customized by choosing from a variety of different decorations or ornaments. The ornaments may be interchanged with other ornaments to personalize the casket. A decorative ornament is attached to a casket having an ornament attachment plate. The ornament may be attached to corner member or other portion of the casket. Each ornament attachment plate has a pair of grooves including a straight groove and a curved groove for receiving shoulder screws on the back of the ornament. The ornament can be removed and attached by the same means to a keepsake plaque for friends and family members.

The attachment system of the present invention may be used for attaching casket ornaments other than corner ornaments or for attaching trim, molding and the like. Additionally, the attached system of the present invention is not limited to the death care industry but may be used in other applications as well in which objects are attached together such as furniture molding or small appliance accessory attachment.

DETAILED DESCRIPTION OF THE DRAWINGS

The present invention and its presently preferred embodiments will be better understood by way of reference to the detailed disclosure herebelow and to the accompanying drawings, wherein.

DETAILED DESCRIPTION OF THE PREFERRED EMBODIMENTS OF THE INVENTION

Figure 1:
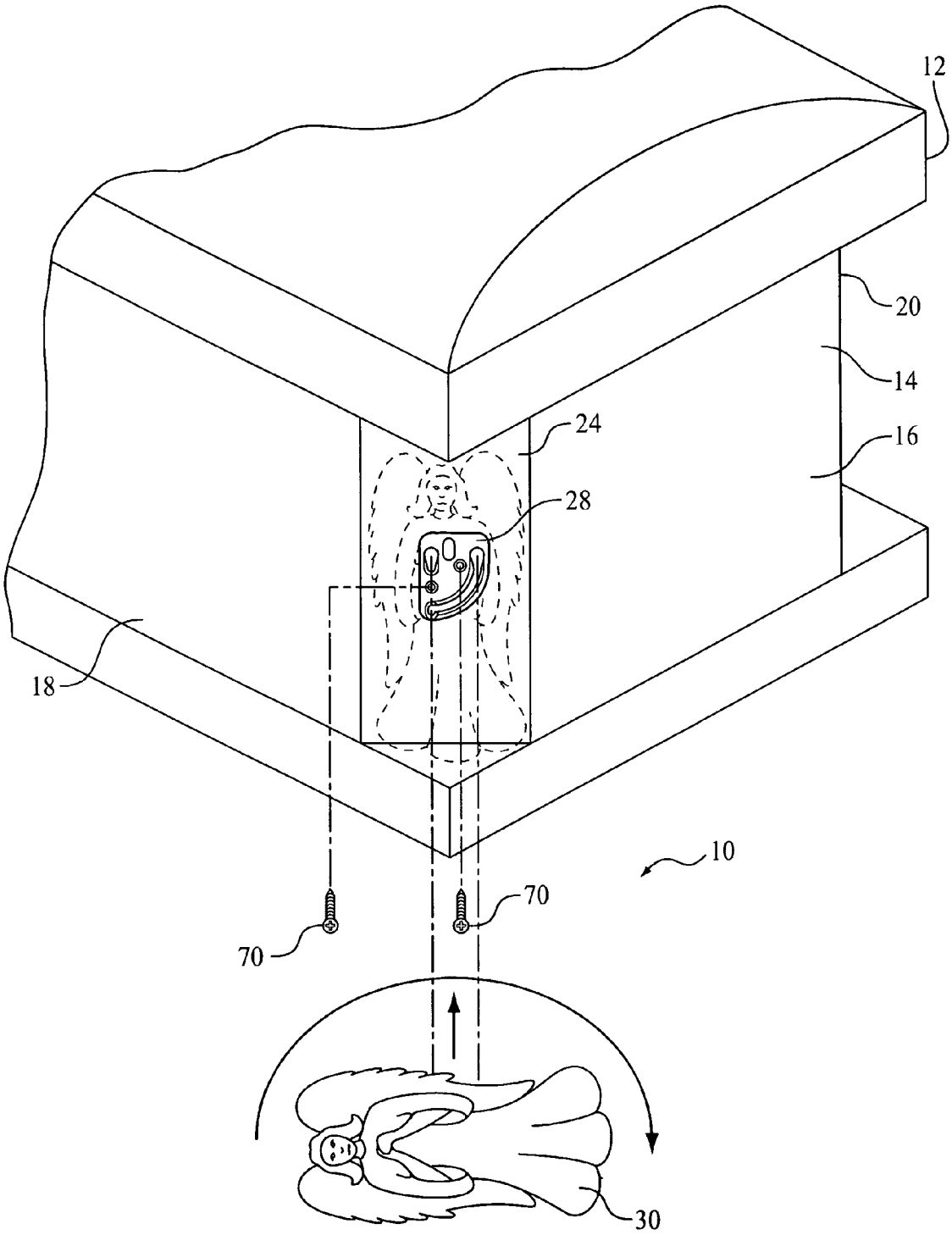
FIG. 1 is an exploded partial perspective view of a casket embodying the casket ornament attachment system of the present invention.
Figure 2:
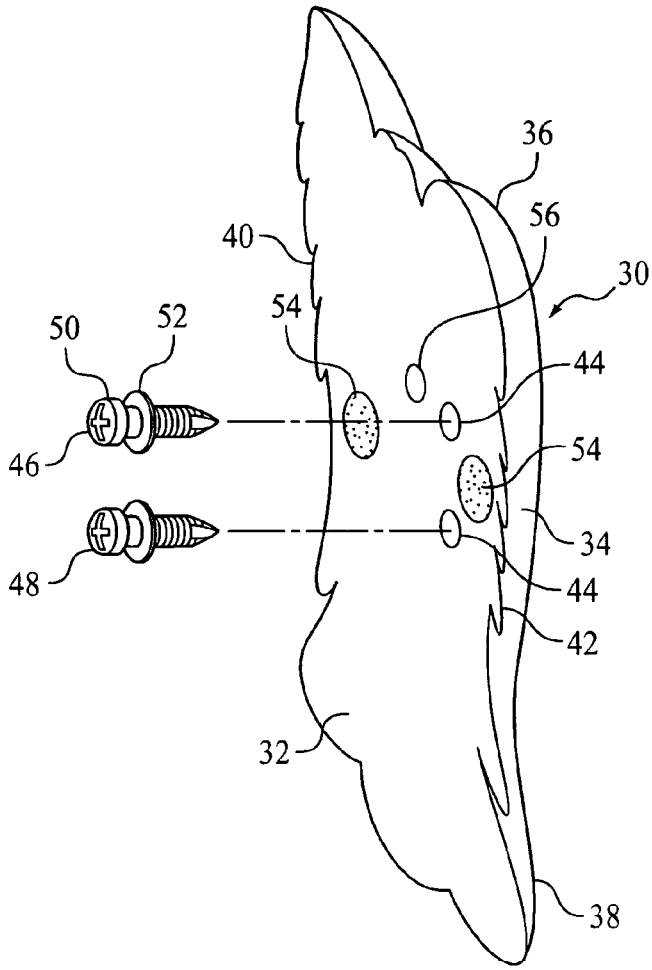
FIG. 2 is a rear exploded perspective view of the ornament and shoulder screws.

Referring to FIGS. 1-6, a casket ornament attachment system 10 according to the present invention is shown. As shown in FIG. 1, a casket 12 comprises a shell 14 having a pair of end walls 16 and a pair of side walls 18 joined to form four corners 20. Each of the corners 20 has a corner member 24 disposed at an angle to a respective end wall 16 and side wall 18. Each corner member 24 has a pocket 26 routed 025 inches deep, 2 inches tall and 1.5 inches wide. The pocket 26 accepts an ornament attachment plate 28 for attaching an interchangeable casket ornament 30.

The casket ornament 30 (FIG. 2) includes a mounting side 32, an ornamental side 34 opposite the mounting side 32, a top portion 36, a bottom portion 38, and first 40 and second 42 edges. The mounting side 32 preferably is flat while the ornamental side 34 preferably has a three-dimensional decorative shape such as an angel (as shown in this illustrative embodiment), a cross, a flag or some other personalized decoration or trim. The mounting side 32 includes a pair of vertically spaced threaded inserts 44 for receiving a pair of fasteners. The fasteners preferably comprise an upper shoulder screw 46 and a lower shoulder screw 48 each having a screw head 50 and a shoulder 52. The pair of vertically spaced threaded inserts 44 is spaced from the second edge 42 one third of the distance between the two edges 40, 42. In other words, the vertically spaced pair of threaded inserts 44 is spaced closer to the right-hand edge 42 when viewed from the mounting side 32 than the other edge 40. Two soft pads 54 are preferably disposed near the pair of threaded inserts 44 on the mounting side 32 of each ornament 30. The pads 54 preferably are formed from a compressible elastomeric layer and an outer felt layer and are attached to the ornament 30 by an adhesive. An optional third threaded insert 56 is disposed at the midpoint between the two edges 40, 42 on the mounting side 32. The third threaded insert 56 may be used in an alternative attachment arrangement by a conventional mounting member.

The ornament attachment plate 28 or member is preferably formed from a polycarbonate material and has a front side 58 and a rear side 60 and includes two ramped grooves 62, 64, an oblong groove 66 and two attachment holes 68. Two fasteners 70 (FIG. 1), preferably #6 flat head wood screws, are insertable through the attachment holes 68 to attach the ornament attachment plate 28 to the pocket 26. The oblong groove 66 will line up with the third threaded insert 56.

Figure 3:
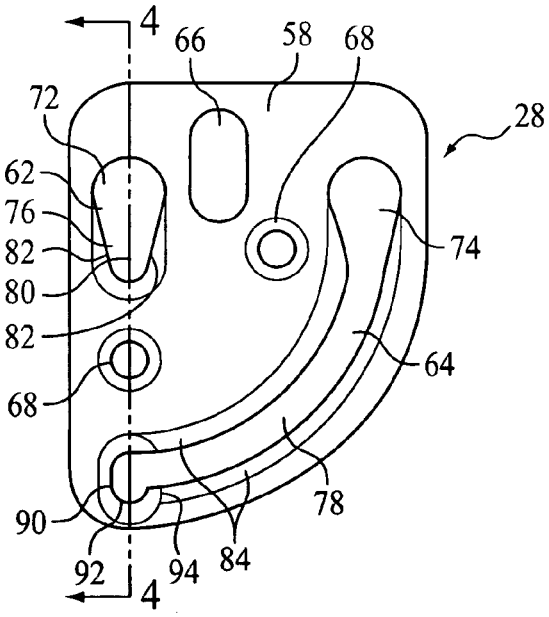
FIG. 3 is a front view of the ornament attachment plate according to the principles of the present invention.
Figure 4:
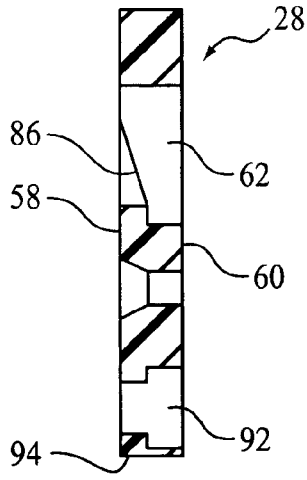
FIG. 4 is a cross-section through section 4-4 of FIG. 1.
Figure 5:
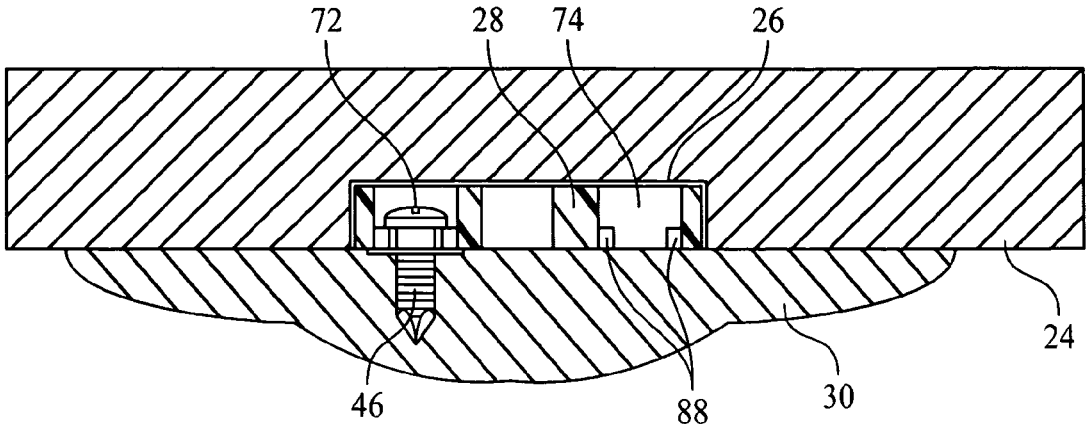
FIG. 5 is a cross-section through the casket, ornament and ornament attachment plate taken through the rounded openings of the grooves looking from the top.
Figure 6:
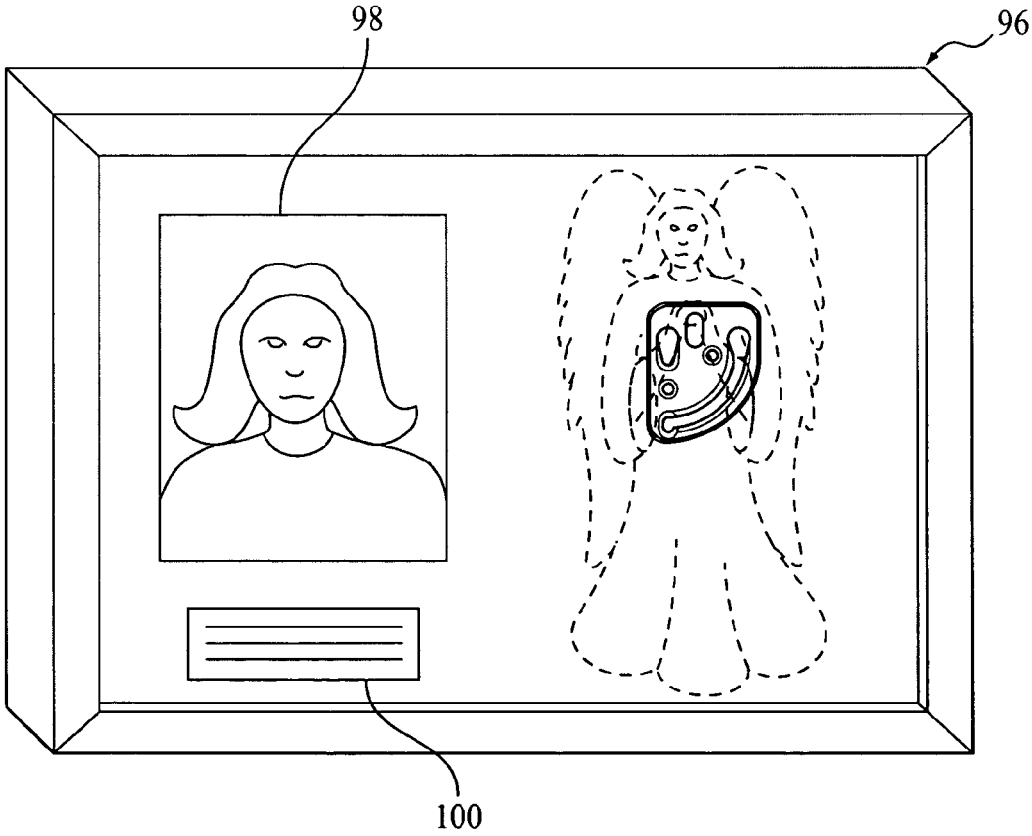
FIG. 6 is a front view of a keepsake plaque.

The two ramped grooves 62, 64 comprise a straight groove 62 and a curved groove 64 (FIG. 3). Each groove 62, 64 has a larger rounded opening 72, 74 at the top and a slot 76, 78 along its length. The straight groove 62 is vertical, shorter and straight. The curved groove 64 is longer and curves downwardly about an origin of radius located at a bottom portion 80 of the straight groove. Each slot 76, 78 includes opposed ribs 82, 84 along its length. The ribs 82 of the vertical groove slot 76 extend downwardly towards each other from the rounded opening 72 to the bottom portion 80 forming an inverted teardrop shaped opening. These ribs 82 have a ramp portion 86 which ramps towards the rear side 60 of the ornament attachment plate 28 (FIG. 4). The ribs 84 of the curved groove slot 84 have an upper portion 88 which is also ramped toward the rear side 60 of the ornament attachment plate 28. The screw heads 50 of the shoulder screws 46, 48 are insertable into the rounded openings 72, 74, but once each screw 46, 48 is moved into a slot 76, 78, the ribs 82, 84 engage the screw shoulder 52 and prevent the screw 46, 48 from coming out of the slot 76, 78. The bottom portion 90 of the curved groove slot 78 ends in a vertical slot 92. Also, the rib portion 84 surrounding this bottom portion 90 is slightly stepped 94 in a direction towards the front side 58 of the ornament attachment plate 28 (FIG. 3).

In order to install an ornament 30 onto a casket corner 20, the user holds the ornament 30 in both hands rotated ninety degrees from its intended resting position (FIG. 1). In the illustrated embodiment in which the ornament 30 is an angel, the angel would be laying on her right side with her head to the left, as shown in FIG. 1. The user presses the ornament 30 against the ornament attachment plate 28 so that shoulder screw heads 50 enter the rounded openings 72, 74 at the top of each groove 62, 64. Once the shoulder screw heads 50 are in the straight 62 and curved grooves 64, the ornament 30 is pressed against the ornament attachment plate 28, thereby compressing the pads 54, and rotated downwardly into position. The top portion 36 of the ornament 30 is held down while the bottom portion 38 is rotated down (clockwise). In other words, the angel is swung to a standing position. The upper shoulder screw 46 is lowered to the bottom portion 80 of the straight groove slot 76 where it becomes the pivot point for the lower shoulder screw 48 to swing about as it is lowered through the curved groove slot 78. When the angel is near the standing position the lower shoulder screw 48 will go down the slight step 94 in the bottom portion 90 of the curved groove 64 which will allow the pads 54 to expand slightly. The pads 54 act as springs that are compressed in order to keep the shoulder screws 46, 48 secure in each groove 62, 64.

In order to remove the ornament 30, the step must be overcome. As the casket 12 is subjected to vibration, the ornament 30 will not inadvertently come loose because of this step 94 in the bottom portion of the curved groove 64. The lower shoulder screw 48 comes to rest in the vertical slot 92 at the bottom portion 90 of the curved groove 64. When the lower shoulder screw 48 rests in the vertical slot 92, the ornament 30 stays vertically oriented and aligned. In order to remove the ornament 30, the ornament 30 is gently pressed against the ornament attachment plate 28, compressing the pads 54, and rotated counter-clockwise ninety degrees and then up and out of the straight and curved grooves 62, 64.

After the ornament 30 is removed, it can be attached using an ornament attachment plate 28 as described above, to a keepsake plaque 96 (FIG. 4) for friends and family members. The plaque 96 also has a place to put a photo 98 of the deceased and a metal strip 100 that can be engraved and adhered to the plaque 96. The plaque 96 can be hung on the wall or stood up on a table or shelf.

Although the present invention has been described in detail for the purpose of illustration, it is to be understood that such detail is solely for that purpose and that variations can be made therein by those in the art without departing form the spirit and scope of the invention.

What is claimed is:

1. An attachment member for removeably attaching a first object to a second object comprising:

a straight groove having a first end and a second end; and a curved groove having a first end and a second end the curved groove curving about an origin of radius at the second end of the straight groove;

wherein the straight groove and the curved groove are adapted for receiving fasteners attached to one of said first and second objects; wherein each of the first ends of the straight groove and the curved groove includes a rounded opening; wherein the straight groove and the curved groove include slots extending from their respective first and second ends; and wherein the slots include opposed ribs.

2. The attachment member of claim 1, wherein the second end of the curved groove includes a stepped portion.

3. The attachment member of claim 2, wherein the second end of the curved groove includes a vertical slot portion.

4. The attachment member of claim 3, wherein the straight groove and the curved groove include ramped portions.

5. An ornament attachment member for removeably attaching an ornament to a casket comprising:

a straight groove having a first end and a second end; and a curved groove having a first end and the curved groove curving about an origin of radius at the second end of the straight groove;

wherein the straight groove and the curved groove are adapted for receiving fasteners attached to the ornament; wherein each of the first ends of the straight groove and the curved groove includes a rounded opening; wherein the straight groove and the curved groove include slots extending from their respective first and second ends: and wherein the slots include opposed ribs.

6. The ornament attachment member of claim 5, wherein the second end of the curved groove includes a stepped portion.

7. The ornament attachment member of claim 6, wherein the second end of the curved groove includes a vertical slot portion.

8. The ornament attachment member of claim 7, wherein the straight groove and the curved groove include ramped portions.

9. A casket comprising:

a shell;

an ornament having a pair of fasteners;

an ornament attachment member attached to the shell for removeably attaching the ornament, the ornament attachment member comprising:

a straight groove having a first end and a second end;

a curved groove having a first end and a second end the curved groove curving about an origin of radius at the second end of the straight groove;

wherein the straight groove and the curved groove are adapted for receiving the pair of fasteners attached to the ornament.

10. The casket of claim 9, wherein each of the first ends of the straight groove and the curved groove includes a rounded opening.

11. The casket of claim 10, wherein the straight groove and the curved groove include slots extending from their respective first and second ends.

12. The casket of claim 11, wherein the slots include opposed ribs.

13. The casket of claim 12, wherein the second end of the curved groove includes a stepped portion.

14. The casket of claim 13, wherein the second end of the curved groove includes a vertical slot portion.

15. The casket of claim 14, wherein the straight groove and the curved groove include ramped portions.

16. The casket member of claim 9, wherein the shell further includes a corner member and the ornament attachment member is attached to the corner member.

17. A method of securing an ornament having first and second fasteners to a casket shell, the casket shell having an ornament attachment member having a straight groove and a curved groove having first and second ends, the method comprising:

inserting the first fastener into the first end of the straight groove and the second fastener into the first end of the curved groove;

moving the first fastener into the second end of the straight groove;

rotating the ornament about the second end of the straight groove to move the second fastener into the second end of the curved groove.

18. The method of claim 17, wherein the ornament further comprises at least one pad and wherein rotating the ornament further includes compressing the at least one pad.

19. A casket ornament system comprising:

a casket ornament having a pair of fasteners; and an ornament attachment member adapted for attaching the casket ornament to a casket, the ornament attachment member comprising:

a straight groove having a first end and a second end; and a curved groove having a first end and a second end; the curved groove curving about an origin of radius at the second end of the straight groove;

wherein the straight groove and the curved groove are adapted for receiving the casket ornament fasteners.

20. The ornament attachment system of claim 19, wherein each of the first ends of the straight groove and the curved groove includes a rounded opening.

21. The ornament attachment system of claim 20, wherein the straight groove and the curved groove include slots extending from their respective first and second ends.

22. The ornament attachment system of claim 21, wherein the slots include opposed ribs.

23. The ornament attachment system of claim 22, wherein the second end of the curved groove includes a stepped portion.

24. The ornament attachment system of claim 23, wherein the second end of the curved groove includes a vertical slot potion.

* * * * *